US009378909B2

(12) United States Patent
Gass et al.

(10) Patent No.: US 9,378,909 B2
(45) Date of Patent: Jun. 28, 2016

(54) SPRING CONTACT, INERTIA SWITCH, AND METHOD OF MANUFACTURING AN INERTIA SWITCH

(71) Applicant: CIRCOR AEROSPACE, INC., Corona, CA (US)

(72) Inventors: David Gass, Wading River, NY (US); Brent Salamone, Dix Hills, NY (US); Corey C. Jordan, Selden, NY (US)

(73) Assignee: Circor Aerospace, Inc., Corona, CA (US)

( * ) Notice: Subject to any disclaimer, the term of this patent is extended or adjusted under 35 U.S.C. 154(b) by 150 days.

(21) Appl. No.: 14/461,859

(22) Filed: Aug. 18, 2014

(65) Prior Publication Data

US 2016/0049270 A1 Feb. 18, 2016

(51) Int. Cl.
*H01H 35/14* (2006.01)
*H01H 11/04* (2006.01)

(52) U.S. Cl.
CPC ..... *H01H 35/141* (2013.01); *H01H 11/04* (2013.01); *H01H 35/145* (2013.01)

(58) Field of Classification Search
CPC ..... H01H 35/14; H01H 35/02; H01H 35/144
USPC ..... 200/61.45 R
See application file for complete search history.

(56) References Cited

U.S. PATENT DOCUMENTS 885,052 A 4/1908 Jensen
2,716,168 A 8/1955 Shonka
3,035,520 A 5/1962 Koeppen
3,097,272 A 7/1963 Hautly
3,171,460 A 3/1965 Coldren
3,659,062 A 4/1972 Shea
3,818,160 A 6/1974 Hitchcock
4,032,734 A * 6/1977 Burch ..... H01H 5/30 200/288
4,278,855 A * 7/1981 Rossi ..... H01H 5/18 200/275
4,746,774 A 5/1988 Tetrault et al.
4,789,762 A 12/1988 Miller et al.
4,916,266 A 4/1990 Tetrault
5,134,255 A 7/1992 Tetrault et al.
5,790,010 A * 8/1998 Schwab ..... H01H 37/54 200/407
7,332,685 B1 2/2008 Chou
2014/0076852 A1 3/2014 Kikuchi et al.

* cited by examiner

*Primary Examiner* — Edwin A. Leon
*Assistant Examiner* — Ahmed Saeed
(74) *Attorney, Agent, or Firm* — McNees Wallace & Nurick LLC

(57) ABSTRACT

A spring contact, an inertia switch, and a method of manufacturing an inertia switch are provided. The spring contact includes a conductive body portion having an outer edge and an inner edge partially surrounding an open area, a split in the conductive body portion, the split extending between the outer edge and the inner edge, and a conductive contact finger extending from the inner edge into the open area. The inertia switch includes a shell; a mass movably positioned within the shell; the spring contact positioned within the mass; a biasing member positioned between the spring contact and the header; and a conductive member extending through the header. The biasing member provides a bias between the spring contact within the mass and the conductive member. The method includes at least partially closing the split in the spring contact during insertion of the spring contact within the mass.

18 Claims, 8 Drawing Sheets

SPRING CONTACT, INERTIA SWITCH, AND METHOD OF MANUFACTURING AN INERTIA SWITCH

FIELD OF THE INVENTION

The present invention is directed to a spring contact, an inertia switch, and a method of manufacturing an inertia switch. More specifically, the present invention is directed to a split spring contact in an inertia switch, and a method of manufacturing an inertia switch including a split spring contact.

BACKGROUND OF THE INVENTION

Inertia switches provide a means for detecting changes in axial or lateral forces. Some currently available inertia switch includes acceleration switches, which, as the name implies, are responsive to acceleration. Typically, an acceleration switch includes a system whereby a mass moves relative to an internal sensing element in response to acceleration.

One specific type of acceleration switch includes a mass-spring system having a mass with a flat spring contact secured thereto, the mass being biased in an open or closed position with respect to a conductive lead wire. The mass may be biased through use of a spring that provides a predetermined spring bias. When sufficient axial or lateral forces are applied to overcome the spring bias, the mass moves relative to the conductive lead wire. The movement of the mass separates the flat spring contact from, or brings the flat spring contact into contact with, the conductive lead wire to open or close the switch, respectively. Often, the flat spring contact is pressed into the mass with an interference fit for retention and electrical conductivity. However, the interference fit causes undue stress on the thin spring contact which results in various deformations, adversely affecting the function of the switch.

Additionally, current mass-spring systems utilize a manually-operated arbor tool to press the flat spring contact into the mass, which results in deformation to the spring contact from the high forces required to overcome the interference between the spring contact and the mass. This deformation may cause dimensional changes to the interface between the spring and the spring contact, adversely affecting the function of the switch.

Furthermore, current spring contact manufacturing includes forming a large number of individual spring contacts on a sheet of spring contact material. A break-off tab is provided for separating each spring contact from the sheet. As shown in FIG. 1, this break-off tab results in a protruding section of the spring contact which scrapes the inside of the mass during the insertion process, resulting in contact deformation. The interference press fit also creates particulate from the spring contact shaving material from the mass. This particulate may cause additional deformation to the spring contact, increasing the friction of the mass movement, and changing the electrical characteristics of the switch; all of which adversely affect the function of the switch.

A spring contact implemented in an inertia switch, and method of manufacturing an inertia switch with improvements in the process and/or the properties of the components formed would be desirable in the art.

SUMMARY OF THE INVENTION

In one embodiment, a spring contact includes a conductive body portion having an outer edge and an inner edge partially surrounding an open area, a split in the conductive body portion, the split extending between the outer edge and the inner edge, and a conductive contact finger extending from the inner edge into the open area.

In another embodiment, an inertia switch includes a shell; a mass movably positioned within the shell; a spring contact positioned within the mass, the spring contact comprising a conductive body portion having an outer edge and an inner edge partially surrounding an open area, a split in the conductive body portion, the split extending between the outer edge and the inner edge, and a conductive contact finger extending from the inner edge into the open area; a header; a biasing member positioned between the spring contact and the header; and a conductive member extending through the header. The biasing member provides a bias between the spring contact within the mass and the conductive member.

In another embodiment, a method of manufacturing an inertia switch includes forming at least one spring contact in a sheet of material, the spring contact comprising a conductive body portion having an outer edge and an inner edge partially surrounding an open area, a split in the conductive body portion, the split extending between the outer edge and the inner edge, a conductive contact finger extending from the inner edge into the open area, and a break-off tab extending between the spring contact and the sheet; separating the at least one spring contact from the sheet; providing a mass; inserting a spring contact of the at least one spring contacts within the mass; providing a shell having a first conductive member secured thereto; positioning the mass within the shell; providing a header having a second conductive member extending therethrough; positioning a biasing member between the header and the spring contact; and securing the header to the shell. The biasing member provides a bias between the spring contact and the second conductive member.

An advantage of the spring contact of the present invention is that the split in the conductive body portion of the spring contact decreases the stresses applied to the spring contact during insertion of the spring contact within the mass.

Another advantage is that the decreased stress applied to the spring contact of the present invention decreases or eliminates spring contact deformation during insertion.

Another advantage is that decreasing or eliminating the deformation of the spring contact of the present invention provides increased performance reliability.

Yet another advantage of the spring contact of the present invention is that a predetermined geometry of the break-off tab decreases particulate formation during insertion of the spring contact within the mass.

Still another advantage is that compressing the spring contact to decrease a size of the split during insertion generates a radially outward force against the mass that provides a uniform or substantially uniform contact between the spring contact and the mass.

A further advantage is that the radially outward force of the spring contact increases a retention of the spring contact of the present invention within the mass.

Another advantage is that the break-off tab is shaped to control deflection of the spring contact of the present invention.

An advantage of the inertia switch is that the spring contact of the present invention decreases or eliminates chatter.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
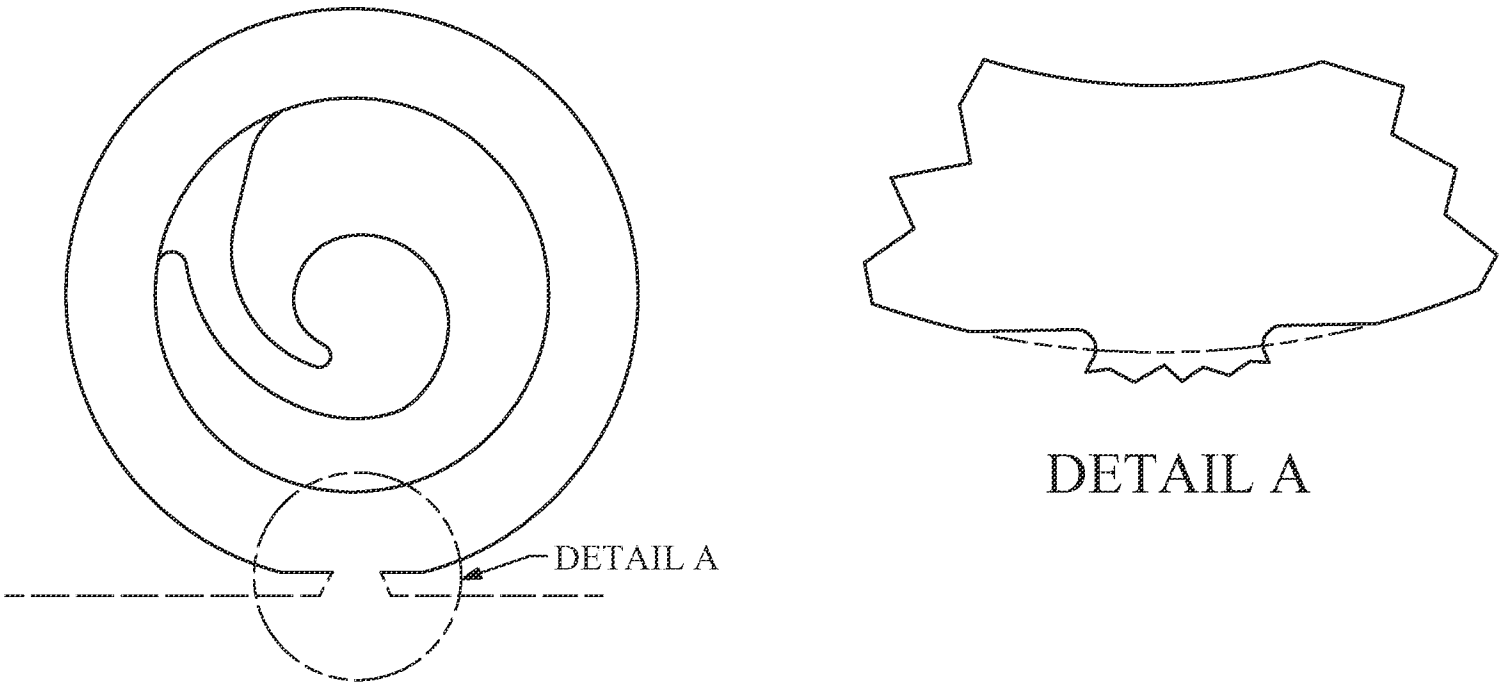
FIG. 1 PRIOR ART
FIG. 1 is a front view of a spring contact according to the prior art.
Figure 2:
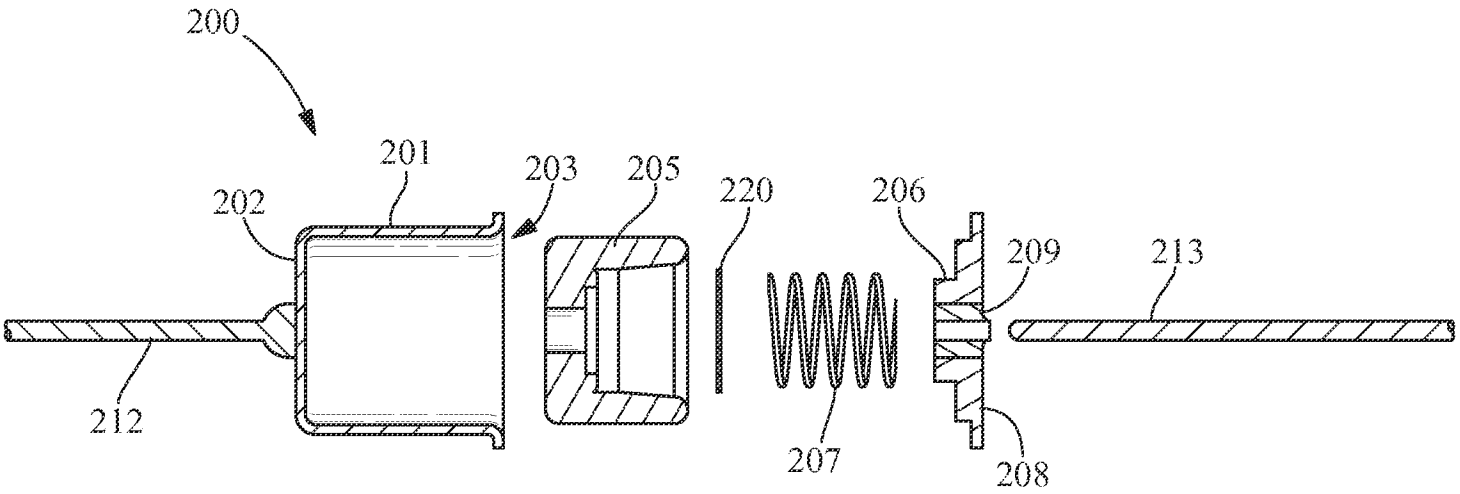
FIG. 2 is an exploded cross-section view of an inertia switch according to an embodiment of the disclosure.

Referring to FIGS. 2-5, an inertia switch 200 includes any switch that is opened and/or closed by lateral or axial forces, such as, but not limited to, an acceleration switch, a miniature acceleration switch, an impact switch, any switch requiring chatter-proof contact (e.g., a chatter-proof miniature acceleration switch, an impact switch requiring little or no contact bounce), or a combination thereof. In one embodiment, the inertia switch 200 includes a shell 201 having a first end 202 and a second end 203. In another embodiment, the shell 201 is hollow, with the first end 202 being closed and the second end 203 being open. A first conductive member 212 is secured to the closed first end 202 by any suitable method for making an electrical connection, such as, but not limited to brazing, soldering, percussive welding, spot welding and the like.

The second end 203 is sealed with a cover assembly, such as a header 208. The header 208 is secured to the second end 203 by any suitable method for forming a hermetic seal, such as, but not limited to, welding, diffusion bonding, brazing, or a combination thereof. Alternatively, the header 208 may engage mating threads in the second end 203, and compress an O-ring therebetween, providing the seal. In one embodiment, the hermetically sealed shell may be filled with an inert gas or a liquid for damping purposes. In another embodiment, a second conductive member 213 extends through the header 208 and projects into the shell 201. A portion of the second conductive member 213 is secured within, and surrounded by, an insulated portion 209 of the header 208, the insulated portion 209 being formed from glass, ceramic, polymer, or any other insulating or electrically non-conductive material. The first conductive member 212 and/or the second conductive member 213 may form a lead wire, as illustrated in FIGS. 2-5, or may include any other suitable material and/or geometry for providing conduction therethrough.

A spring contact 220 is positioned within a mass 205, which is movably positioned within the interior of the shell 201. A biasing member 207, such as a coil spring, is also positioned within the interior of the shell 201, between the header 208, and the spring contact 220 and/or the mass 205. The mass 205 is counterbored to provide a recess for receiving the spring contact 220 and the biasing member 207. For example, in one embodiment, the biasing member 207 extends between an annular shoulder 206 of the header 208 and the spring contact 220 within the counterbore of the mass 205. In another example, the biasing member 207 is secured within the counterbore of the mass 205 and to the header 208. The counterbore may include spring guides corresponding to the biasing member 207. In one embodiment, in the absence of sufficient lateral or axial forces, the biasing member 207, or other biasing member, provides a biasing force that maintains an orientation of the spring contact 220 relative to the second conductive member 213. The lateral or axial forces include any forces that act with or against the biasing force of the biasing member 207 or other biasing member, such as, but not limited to, forces from acceleration, impact, applied forces, or a combination thereof.

The first conductive member 212, the second conductive member 213, the shell 201, the mass 205, the spring contact 220, the biasing member 207, and/or the header 208 are formed from any conductive material, such as, but not limited to, a conductive metal, a conductive alloy, or a combination thereof. The first conductive member 212 and/or the second conductive member 213 may be provided with a protective layer of electrically non-conductive insulation, such as is common in, for example, insulated wire. When the second conductive member 213 is brought into contact with the spring contact 220 a continuous electric circuit is formed by the switch 200, the circuit formed between the first conductive member 212 and the second conductive member 213. For example, in one embodiment, on closing the switch 200 a conductive path is formed from the first conductive member 212 to the shell 201, from the shell 201 to the mass 205, from the mass 205 to the spring contact 220, and from the spring contact 220 to the second conductive member 213. In another embodiment, the conductive path is formed from the first conductive member 212 to the shell 201, from the shell 201 to the header 208, from the header 208 to the biasing member 207, from the biasing member 207 to the spring contact 220, and from the spring contact 220 to the second conductive member 213.

Figure 3:
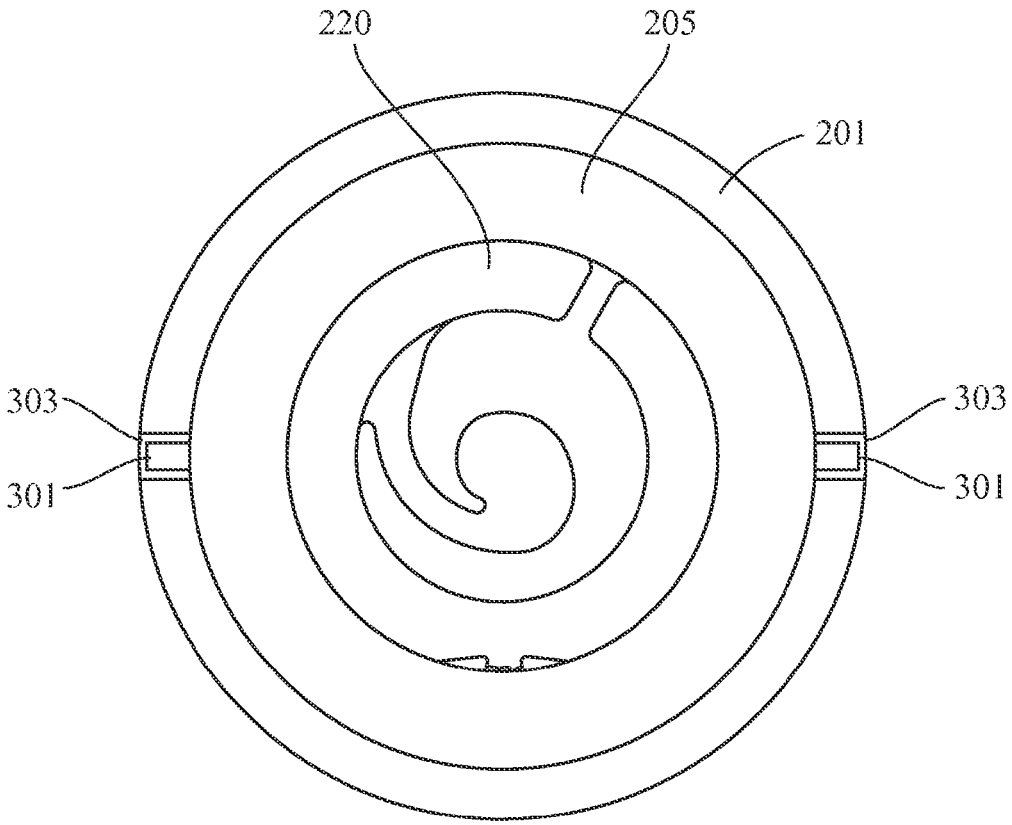
FIG. 3 is a front view of a mass positioned within a shell.

To open or close the switch 200, the mass 205 moves within the shell 201, moving the spring contact 220 relative to the second conductive member 213. A shape of the mass 205 may be complementary to, or dissimilar from a shape of the shell 201, so long as the mass 205 is able to move axially or laterally within the shell 201. For example, in one embodiment, the shell 201 has an interior cylindrical shape and the mass 205 includes a cylindrical cup-shaped mass sized to fit within the shell 201. Other suitable shapes of the mass 205 include, but are not limited to, square, triangular, polygonal, conical, frustoconical, any other shape for sliding or otherwise moving within the shell 201, or a combination thereof. As illustrated in FIG. 3, the mass 205 may have, for example, splines 301 that reside in corresponding grooves 303 in the shell 201 thereby restricting the mass 205 to coaxial movement within the shell 201.

Figure 4:
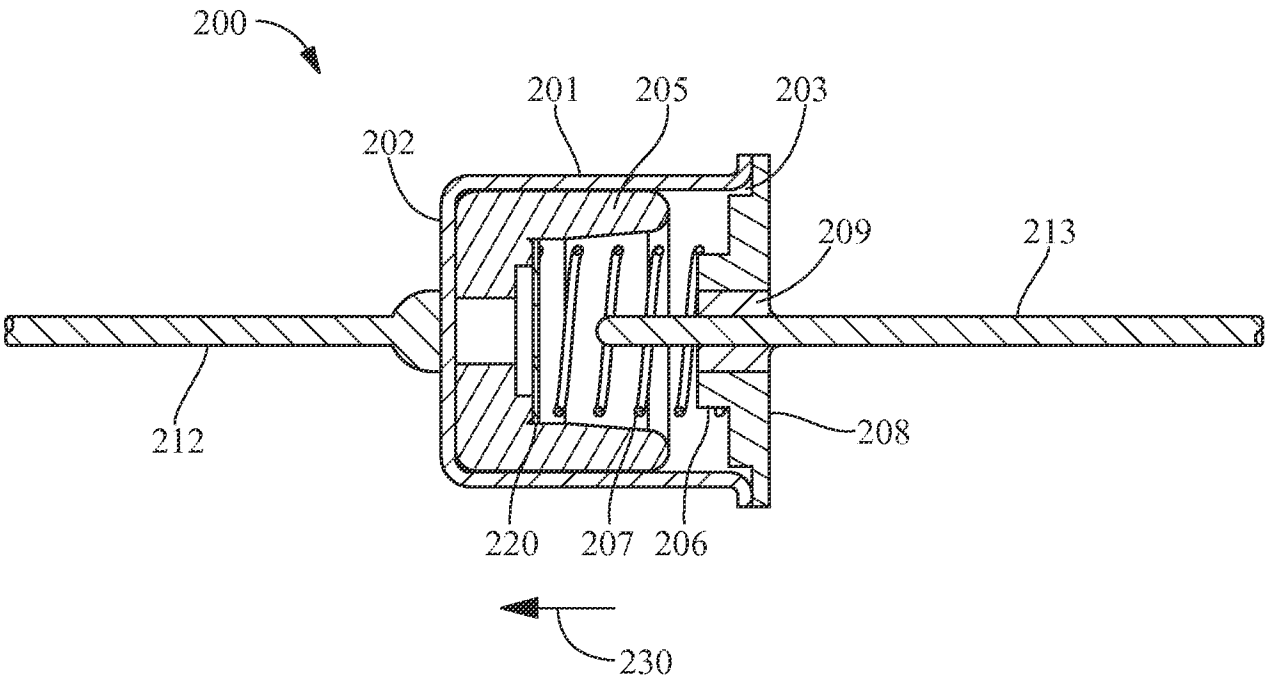
FIG. 4 is a cross-section view of an open inertia switch according to an embodiment of the disclosure.

Referring to FIG. 4, in one embodiment, a length of the biasing member 207 is greater than or equal to a distance between the mass 205 and the header 208 in an open position. The length of the biasing member 207 provides an expansive force 230 that biases the spring contact 220 and the second conductive member 213 apart. In the absence of lateral or axial forces sufficient to overcome the spring bias, the expansive force 230 maintains the inertia switch 200 in an open position, i.e. a space is provided between the spring contact 220 and the second conductive member 213. When lateral or axial forces are applied to overcome the spring bias the mass 205 moves towards the second end 203, compressing the biasing member 207 and bringing the spring contact 220 into contact with the second conductive member 213. A spring constant of the biasing member 207 is selectable base on the axial forces experienced by the switch 200 which are required, in this example, to close the circuit.

Figure 5:
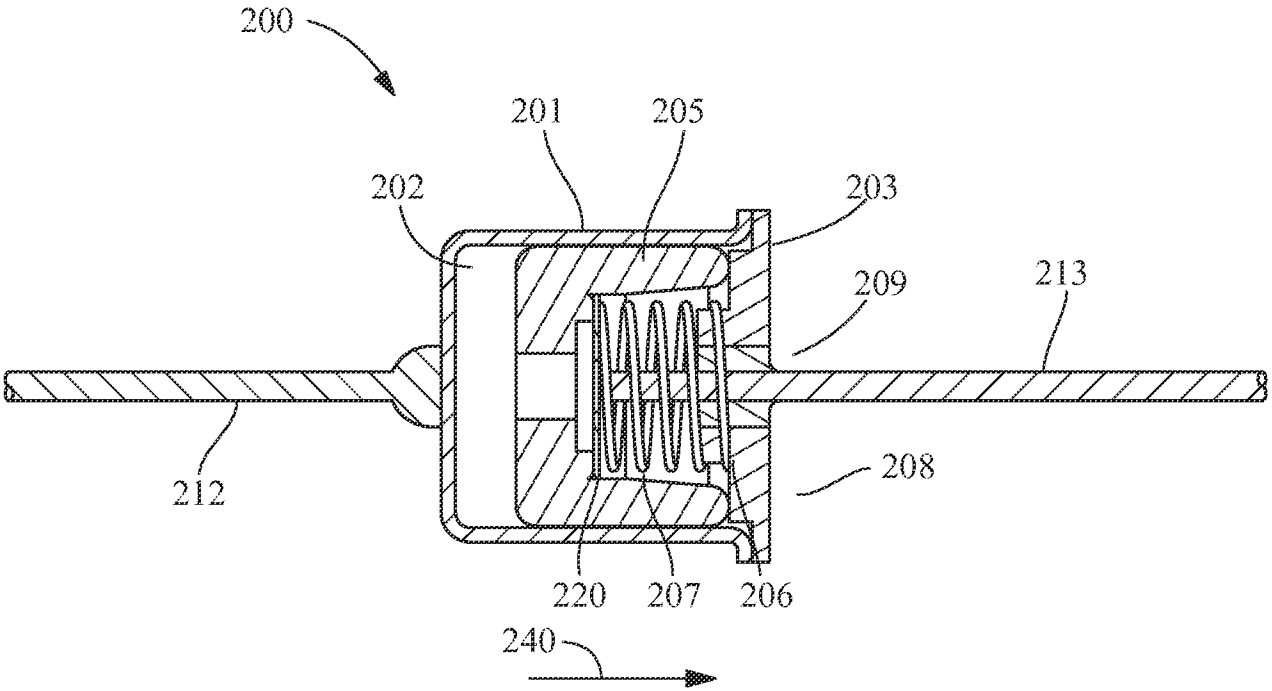
FIG. 5 is a cross-section view of a closed inertia switch according to an embodiment of the disclosure.

Referring to FIG. 5, in an alternate embodiment, the length of the biasing member 207 is less than or equal to the length between the mass 205 and the header 208 in a closed position. When secured to the mass 205 and the header 208, the length of the biasing member 207 provides a retractive force 240 that biases the spring contact 220 and the second conductive member 213 together. The biasing member 207 is secured to the mass 205 and/or the header 208 by any suitable securing method, such as, but not limited to, adhesives, guides, metal bonding (e.g., welding), mechanical force, clips, latches, protrusions, or a combination thereof. In the absence of lateral or axial forces sufficient to overcome the spring bias, the retractive force 204 maintains the inertia switch 200 in a closed position, i.e. the spring contact 220 and the second conductive member 213 are in contact with each other. When lateral or axial forces are applied to overcome the spring bias the mass 205 moves away from the second end 203, expanding the biasing member 207 and breaking the contact between the spring contact 220 and the second conductive member 213.

In another alternative embodiment, the biasing member 207 is positioned between the first end 202 of the shell 201 and the mass 205 (not shown). The biasing member 207 biases the mass 205 toward the second end 203, biasing the spring contact 220 into contact with the second conductive member 213. In the absence of lateral or axial forces sufficient to overcome the spring bias, the inertia switch 200 is maintained in the closed position. When lateral or axial forces are applied to overcome the spring bias the mass 205 moves away from the second end 203, compressing the biasing member 207 between the mass 205 and the first end 202, and breaking the contact between the spring contact 220 and the second conductive member 213.

Figure 6:
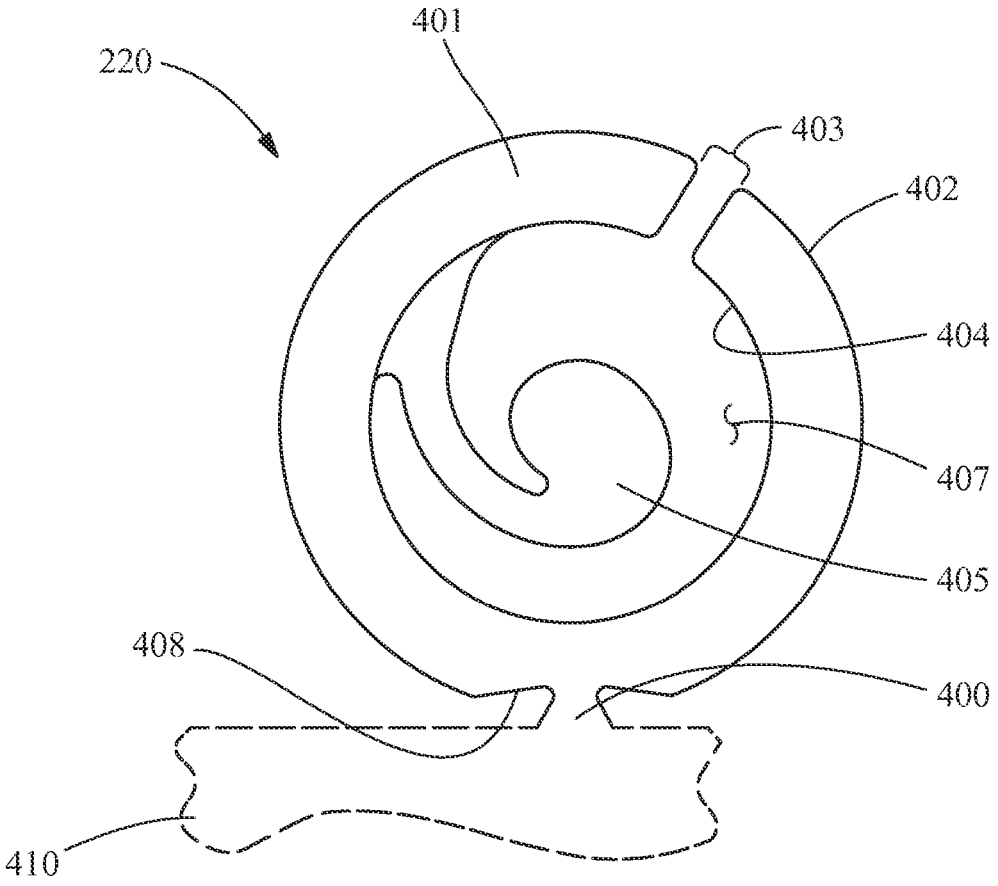
FIG. 6 is a front view of a spring contact according to an embodiment of the disclosure.

Referring to FIG. 6, the spring contact 220 includes a conductive body portion 401 having an outer edge 402, an inner edge 404, and a split 403 extending between the outer edge 402 and the inner edge 404 forming a split ring. In one embodiment, the inner edge 404 defines, and partially surrounds, an open area 407 within the spring contact 220. In another embodiment, a conductive contact finger 405 extends from the inner edge 404 of the conductive body portion 401 into the open area 407. Together, the outer edge 402 and the inner edge 404 define a predetermined shape of the conductive body portion 401. For example, in one embodiment, the conductive body portion 401 is annular, with the split 403 providing an open gap therein defining a split ring. Other predetermined shapes of the conductive body portion 401 include any shape configured to be positioned within the mass 205 (FIGS. 3-5), such as, but are not limited to, oval, square, triangular, rectangular, polygonal, or a combination thereof. Preferably the shapes are printed using ink or readily stamped, coined, laser cut or photo-chemically etched from a sheet of conductive material, such as, but not limited to, beryllium copper or electrical steel. Generally, the spring contact 220 has a planar geometry of preselected thickness for the conductive body (between the inner and outer edge) and a conductive contact finger with different preselected thickness. The flexible contact may be of a different thickness than the outer portion of the contact.

When inserted within the mass 205, at least a portion of the outer edge 402 contacts an inner surface of the mass 205, providing an interference fit between the spring contact 220 and the mass 205. In one embodiment, a radial force is generated between the inner surface of the mass 205 and the spring contact 220. In another embodiment, the split 403 in the body portion 201 at least partially closes or compresses in response to the radial force. In a further embodiment, at least one feature is provided on either side of the split 403, each feature configured to mate with a corresponding feature on an insertion tool. The at least one feature includes, for example, an aperture, a protrusion, a slot, or a combination thereof. When one or more of the at least one features provided on each side of the split 403 is mated with the corresponding feature on the insertion tool, actuating the insertion tool at least partially closes the split 403 to facilitate insertion of the spring contact 220 within the counterbore of the mass 205. The at least partial closing of the split 403 generates a radial spring-loaded force in the spring contact 220. In one embodiment, the radial spring-loaded force is applied against the inner surface of the mass 205, maintaining the position of the spring contact 220 and/or providing electrical conductivity between the spring contact 220 and the mass 205. In another embodiment, a recess is provided within the counterbore of the mass 205, such as, for example, in a base of the mass 205. When the spring contact 220 is inserted to the recess within the mass 205, the partially closed body portion 201 expands into the recess, locking the spring contact 220 within the recess. In another embodiment, the inner surface of mass 205 contains a lead-in angle, so that split 403 of spring contact 220 gets partially closed during the press-in process, resulting in a radial spring-loaded force between spring contact 220 and mass 205. The break-off tab may be designed so that it will separate from the sheet at a pinch point, defined herein as its narrowest point 455.

Additionally, the partial closing of the split 403 provides a controlled deflection during a press-in, or insertion, of the spring contact 220 within the mass 205. Preferably, the controlled deflection produces no permanent deformation of the spring contact 220. The controlled deflection decreases a friction between the outer edge 402 and the inner surface, which decreases an insertion force necessary to insert the spring contact 220 within the mass 205. By decreasing the insertion force necessary to insert the spring contact 220, the split 403 decreases or eliminates deformation of the body portion 201 and/or the conductive contact finger 405 from the insertion force, providing a planar or substantially flat spring contact 220 with the mass 205. The controlled deflection also permits insertion of the spring contact 220 without regard to the circumferential orientation of the spring contact 220, and with no material removal from the mass 205. Furthermore, the decreased or eliminated deformation of the spring contact 220 and/or the radial spring-loaded force increase reliability in the insertion process, increase performance of the switch 200, provide chatter-proof contact between the spring contact 220 and the second conductive member 213, and/or increase an overall acceptable yield of the switch 200.

Figure 7:
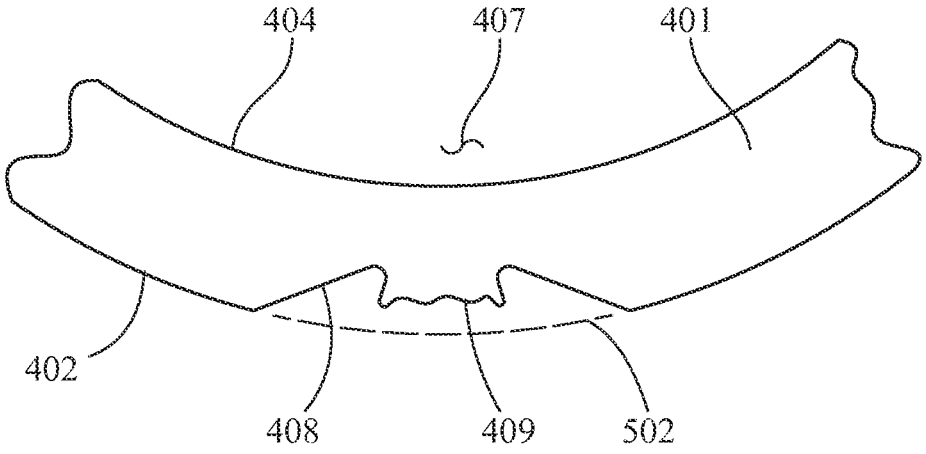
FIG. 7 is an enlarged view of a break-off tab according to an embodiment of the disclosure.

In one embodiment, the spring contact 220 is formed in a sheet of conductive material 210. A plurality of the spring contacts 200 may be formed in an array, each of the spring contacts 200 being attached to the sheet with a break-off tab 409. As shown in FIGS. 6 and 7, in another embodiment, the break-off tab 409 extends from a recess 408 in the outer edge 402 of the conductive body portion 401. When the spring contact 220 is separated from the sheet 410 the break-off tab 409 is broken, leaving a portion of the break-off tab 409 within the recess 408 in the outer edge 402. As more clearly shown in FIG. 7, the remaining portion of the break-off tab 409 does not extend past a perimeter 502 of the spring contact 220, the perimeter 502 being represented by a dashed line extending the outer edge 402 over the recess 408.

Figure 8:
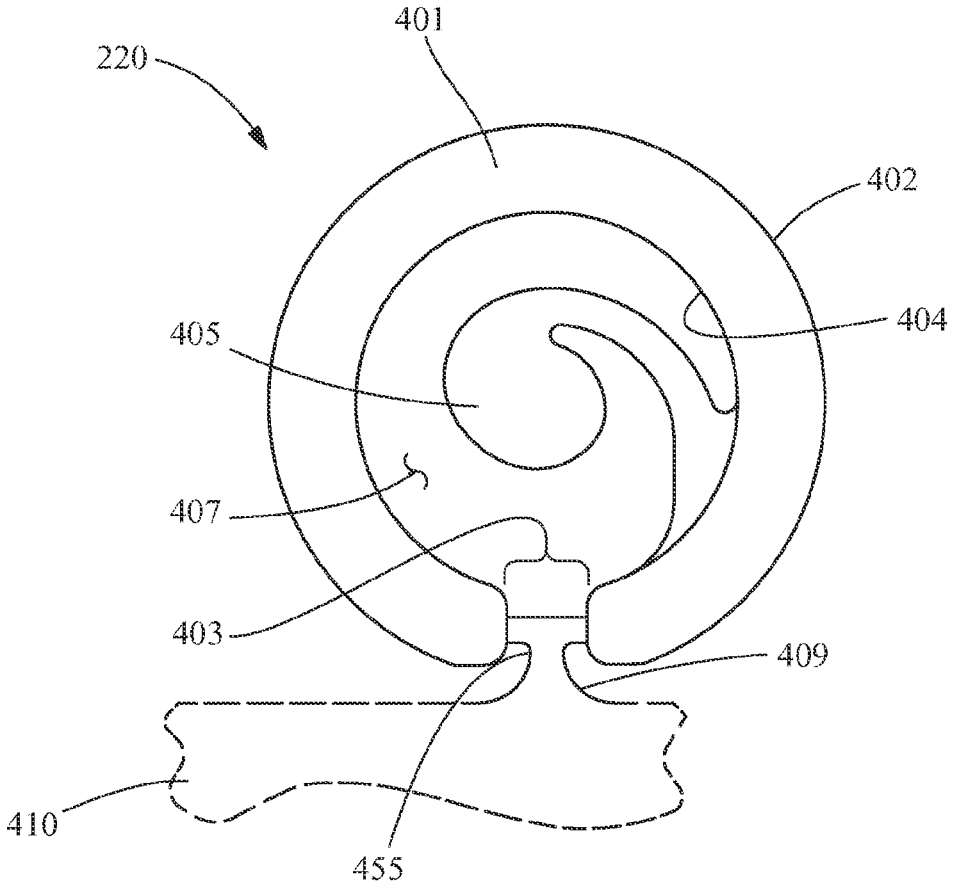
FIG. 8 is a front view of an alternate spring contact according to an embodiment of the disclosure.

Alternatively, as shown in FIG. 8, the break-off tab 409 may extend from within the split 403 in the conductive body portion 401 to the sheet 410. When the spring contact 220 is removed from the sheet 410, the remaining portion of the break-off tab 409 is contained within the split 403 such that, with the exception of the split 403, there are no protrusions or recesses 408 in the outer edge 402 of the conductive body portion 401. In one embodiment, the break-off tab 409 is secured across the split 403, such that when broken there are remaining portions on either side of the split 403. In another embodiment, the break-off tab 409 is only secured to one side of the split 403, leaving the remaining portion extending from only that side.

Positioning the remaining portion of the break-off tab 409 within the recess 408 or the split 403 decreases or eliminates contact between the remaining portion and the inner surface of the mass 205 during insertion of the spring contact 220. In one embodiment, decreasing or eliminating contact between the remaining portion and the inner surface of the mass 205 decreases or eliminates the formation of deleterious particulate from the remaining portion scraping the inner surface of the mass 205. In another embodiment, decreasing or eliminating contact between the remaining portion and the inner surface of the mass 205 decreases or eliminates deformation of the spring contact 220 during insertion. In a further embodiment, a geometry of the break-off tab 409 controls deflection of the spring contact 220 during the press-in process, providing increased reliability in the switch 200. The geometry of the break-off tab 409 and of recess 408 may be designed and positioned with a specific relationship to that of contact finger 405 so that conductive body portion 401 deflects in a controlled manner to minimize the stresses and deformation in both body portion 401 and contact finger 403.

A method of manufacturing the inertia switch 200 includes forming at least one spring contact 220 in the sheet of conductive material 210; separating the at least one spring contact 220 from the sheet 410; providing the mass 205; inserting the spring contact 220 within the mass 205, the radial force applied to the spring contact 220 by the mass 205 at least partially closing the split 403 within the body portion 201; providing the shell 201 with the first conductive member 212 secured thereto; positioning the mass 205 within the shell 201; providing the header 208 with the second conductive member 213 extending therethrough; positioning the biasing member 207 between the header 208 and the spring contact 220; and securing the header 208 to the shell 201, opposite the first conductive member 212. The biasing member 207 provides the biasing force between the spring contact 220 and the second conductive member 213.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An inertia switch, comprising:
- a shell;
- a mass movably positioned within the shell;
- a spring contact positioned within the mass, the spring contact comprising:
  - a conductive body portion having:
    - an outer edge; and
    - an inner edge partially surrounding an open area;
  - an at least partially closable split in the conductive body portion, the split extending between the outer edge and the inner edge, the split being at least partially closable in response to forces applied to the outer edge toward the inner edge; and
  - a conductive contact finger extending from the inner edge into the open area;
- a header;
- a biasing member positioned between the spring contact and the header; and
- a conductive member extending through the header;
- wherein the biasing member provides a bias between the spring contact within the mass and the conductive member.

2. The inertia switch of claim 1, further comprising an insulated portion within the header, the insulated portion surrounding a section of the conductive member extending through the header.

3. The inertia switch of claim 2, wherein the insulated portion comprises glass.

4. The inertia switch of claim 1, further comprising a lead wire secured to the shell.

5. The inertia switch of claim 1, wherein the spring contact is flat.

6. The inertia switch of claim 1, wherein the header further comprises an annular shoulder, the annular shoulder arranged and disposed to receive the biasing member thereon.

7. The inertia switch of claim 1, wherein contact between the spring contact and the conductive member closes the switch.

8. The inertia switch of claim 1, wherein the conductive member comprises a wire.

9. The inertia switch of claim 1, wherein the conductive body portion includes a predetermined geometry.

10. The inertia switch of claim 9, wherein the predetermined geometry comprises an annular geometry.

11. The inertia switch of claim 1, wherein the outer edge defines a perimeter of the spring contact.

12. The inertia switch of claim 1, further comprising a break-off tab.

13. The inertia switch of claim 12, wherein the break-off tab extends from a recess in the outer edge of the conductive body portion.

14. The inertia switch of claim 12, wherein the break-off tab is positioned within the split in the conductive body portion.

15. The inertia switch of claim 12, wherein the break-off tab is arranged and disposed to control deflection of the spring contact.

16. A method of manufacturing an inertia switch, the method comprising:
- forming at least one spring contact in a sheet of material, the spring contact comprising:
  - a conductive body portion having:
    - an outer edge; and
    - an inner edge partially surrounding an open area;
  - an at least partially closable split in the conductive body portion, the split extending between the outer edge and the inner edge;
  - a conductive contact finger extending from the inner edge into the open area; and
  - a break-off tab extending between the spring contact and the sheet;
- separating the at least one spring contact from the sheet;
- providing a mass;

inserting a spring contact of the at least one spring contacts within the mass at least partially closing the split in the conductive body portion during the inserting the spring contact within the mass;

providing a shell having a first conductive member secured thereto;

positioning the mass within the shell;

providing a header having a second conductive member extending therethrough;

positioning a biasing member between the header and the spring contact; and securing the header to the shell;

wherein the biasing member provides a bias between the spring contact and the second conductive member.

17. The method of claim 16, wherein the at least partial closing of the split decreases deformation of the spring contact from the inserting.

18. The method of claim 16, wherein the at least partial closing of the split generates a radial force in the spring contact to maintain a position of the spring contact within the mass and provide electrical conductivity between the spring contact and the mass.

* * * * *